US008196464B2

(12) United States Patent
Kirk et al.

(10) Patent No.: US 8,196,464 B2
(45) Date of Patent: Jun. 12, 2012

(54) APPARATUS AND METHOD FOR MONITORING A HYDRAULIC PUMP ON A MATERIAL HANDLING VEHICLE

(75) Inventors: John Bryant Kirk, Binghamton, NY (US); Jeff Greene, Port Crane, NY (US); Paul Patrick McCabe, Binghamton, NY (US)

(73) Assignee: The Raymond Corporation, Greene, NY (US)

( * ) Notice: Subject to any disclaimer, the term of this patent is extended or adjusted under 35 U.S.C. 154(b) by 395 days.

(21) Appl. No.: 12/652,460

(22) Filed: Jan. 5, 2010

(65) Prior Publication Data

US 2011/0162447 A1 Jul. 7, 2011

(51) Int. Cl.
*G01M 19/00* (2006.01)

(52) U.S. Cl. ..... 73/168; 187/250

(58) Field of Classification Search ..... 73/168
See application file for complete search history.

(56) References Cited

U.S. PATENT DOCUMENTS

| | | | | |
|---|---|---|---|---|
| 4,757,712 | A * | 7/1988 | Jurca | 73/865.9 |
| 5,563,351 | A | 10/1996 | Miller | |
| 6,330,525 | B1 | 12/2001 | Hays et al. | |
| 6,745,153 | B2 | 6/2004 | White et al. | |
| 6,829,542 | B1 | 12/2004 | Reynolds et al. | |
| 6,853,951 | B2 | 2/2005 | Jarrell et al. | |
| 6,882,960 | B2 | 4/2005 | Miller | |
| 7,082,758 | B2 | 8/2006 | Kageyama et al. | |
| 7,103,460 | B1 | 9/2006 | Breed | |
| 7,112,037 | B2 | 9/2006 | Sabini et al. | |
| 7,117,120 | B2 | 10/2006 | Beck et al. | |
| 7,124,057 | B2 | 10/2006 | Forster et al. | |
| 7,143,007 | B2 | 11/2006 | Long et al. | |
| 7,204,138 | B2 | 4/2007 | Du | |
| 7,457,785 | B1 | 11/2008 | Greitzer et al. | |
| 7,542,875 | B2 | 6/2009 | Rogers | |
| 2007/0196213 | A1 | 8/2007 | Parsons et al. | |

FOREIGN PATENT DOCUMENTS

| | | | |
|---|---|---|---|
| EP | 1052215 | A2 * | 11/2000 |
| EP | 1308415 | A2 * | 5/2003 |

OTHER PUBLICATIONS

Machine Translation of EP1052215, Date translated: Mar. 19, 2012, Publisher: European Patent Office, web site: http://worldwide.espacenet.com/, pp. 2.*

Machine Translation of EP1308415, Date translated: Mar. 20, 2012, Publisher: European Patent Office, web site: http://worldwide.espacenet.com/, pp. 23.*

* cited by examiner

*Primary Examiner* — Lisa Caputo
*Assistant Examiner* — Roger Hernandez-Prewitt
(74) *Attorney, Agent, or Firm* — Quarles & Brady LLP; George E. Haas

(57) ABSTRACT

Wear of a pump is estimated using a process that involves operating the pump to drive a hydraulic actuator that moves a member. The actual speed of the member is determined and the speed of the pump is sensed. Pressure of fluid conveyed from the pump to the hydraulic actuator also is sensed. A predicted speed of the member is calculated based on the speed of the pump and the pressure of the fluid. The predicted speed is compared to the actual speed and the result is employed to provide an indication of a degree of wear of the pump. The difference between the predicted speed and the actual speed increases as the pump wear increases.

23 Claims, 3 Drawing Sheets

APPARATUS AND METHOD FOR MONITORING A HYDRAULIC PUMP ON A MATERIAL HANDLING VEHICLE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic pumps, and more particularly to techniques for detecting wear of hydraulic pumps.

2. Description of the Related Art

Hydraulic pumps are used in a wide variety of equipment to provide a source of pressurized hydraulic fluid that then is controlled to operate hydraulic actuators, such as hydraulic motors and hydraulic cylinder and ram assemblies. Over time, the internal components of a pump may wear, thereby leaking fluid which decreases the magnitude of fluid flow produced by the pump. Such leakage not only slows the motion of the hydraulic actuator, it wastes power and raises the temperature of the hydraulic fluid which also are disadvantageous. Over time, the actuator operation degrades to a point where either maintenance or replacement of the pump is necessary.

It is, therefore, desirable to detect if excessive wear of a pump occurs and be able to take remedial action.

Previous techniques for determining excessive pump wear involved sensing an amount of fluid flowing through a drain outlet in the case of the pump. Because pump wear introduces metal particles into the hydraulic fluid, another method periodically measured the size and concentration of solid particles in the fluid. The noise produced by a pump also has been used to detect excessive leakage.

SUMMARY OF THE INVENTION

A pump is connected to a hydraulic actuator that moves a member on a material handling vehicle. Pump wear is estimated by operating the pump to drive the hydraulic actuator to move the member. The actual speed of the member is determined, such as by one or more sensors, and the speed of the pump also is detected. Pressure of fluid conveyed from the pump to the hydraulic actuator is sensed.

The speed of the pump and the pressure of the fluid are employed to calculate a predicted speed. The temperature of the fluid optionally also may be used to calculate a predicted speed. The predicted speed is compared to the actual speed of the member. As the pump wear increases, a difference between the predicted speed and the actual speed increases. An indication of a degree of wear of the pump is produced in response to the comparison of the speeds.

DETAILED DESCRIPTION OF THE INVENTION

Figure 1:
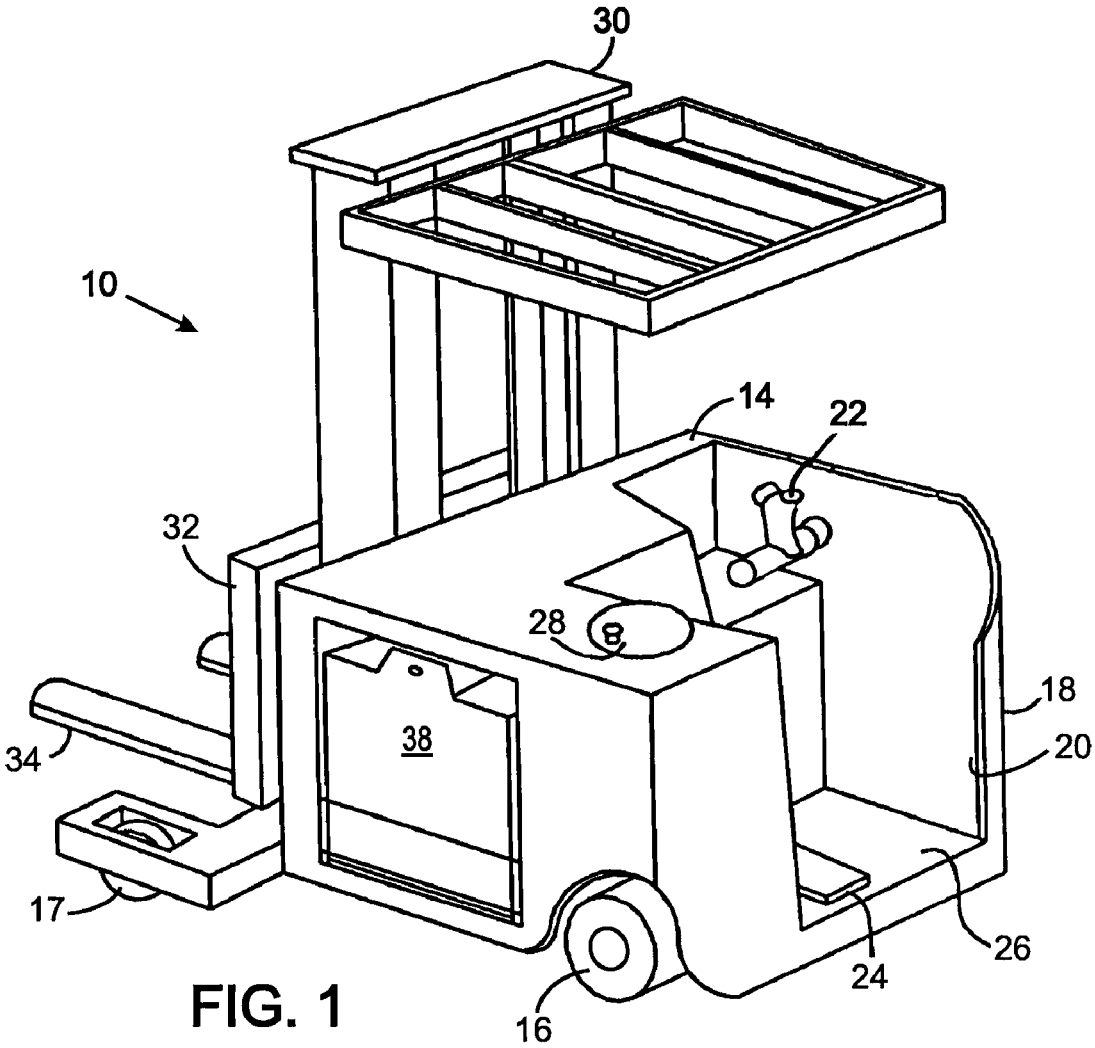
FIG. 1 is a perspective view of a material handling vehicle incorporating the present invention.

Referring initially to FIG. 1, a material handling vehicle 10, such as a lift truck, includes main body 14 mounted on wheels 16 and 17 for movement across a floor of a warehouse or a factory, for example. The body includes an operator compartment 18 with an opening 20 for entry and exit of the operator. The operator compartment 18 contains a multi-function control handle 22 and a deadman switch 24 positioned on the floor 26. The deadman switch 24 must be closed by the operator's foot before any of the motors on the material handling vehicle can operate, which prevents run away operation of the vehicle. A steering wheel 28 is also provided in the operator compartment 18. Although the material handling vehicle 10 is shown by way of example as having a standing, fore-aft operator stance configuration, the present invention is not limited to vehicles of this type, and can also be used with other types of material handling vehicles including, without limitation, pallet trucks, platform trucks, fork material handling vehicles, counterbalanced fork lift vehicles, and other powered vehicles used in a warehouse or a factory to transport, store, and retrieve items.

The material handling vehicle 10 includes a vertical mast 30 secured to the body 14 with a carriage 32 is slideably mounted to the mast for vertical movement between different positions. A pair of forks 34 extends from the carriage 32 to support a load 50 (FIG. 2) that is being transported by the material handling vehicle. By manipulating the multi-function control handle 22, the operator controls the raising and lowering of the carriage 32 on the vertical mast 30.

Figure 2:
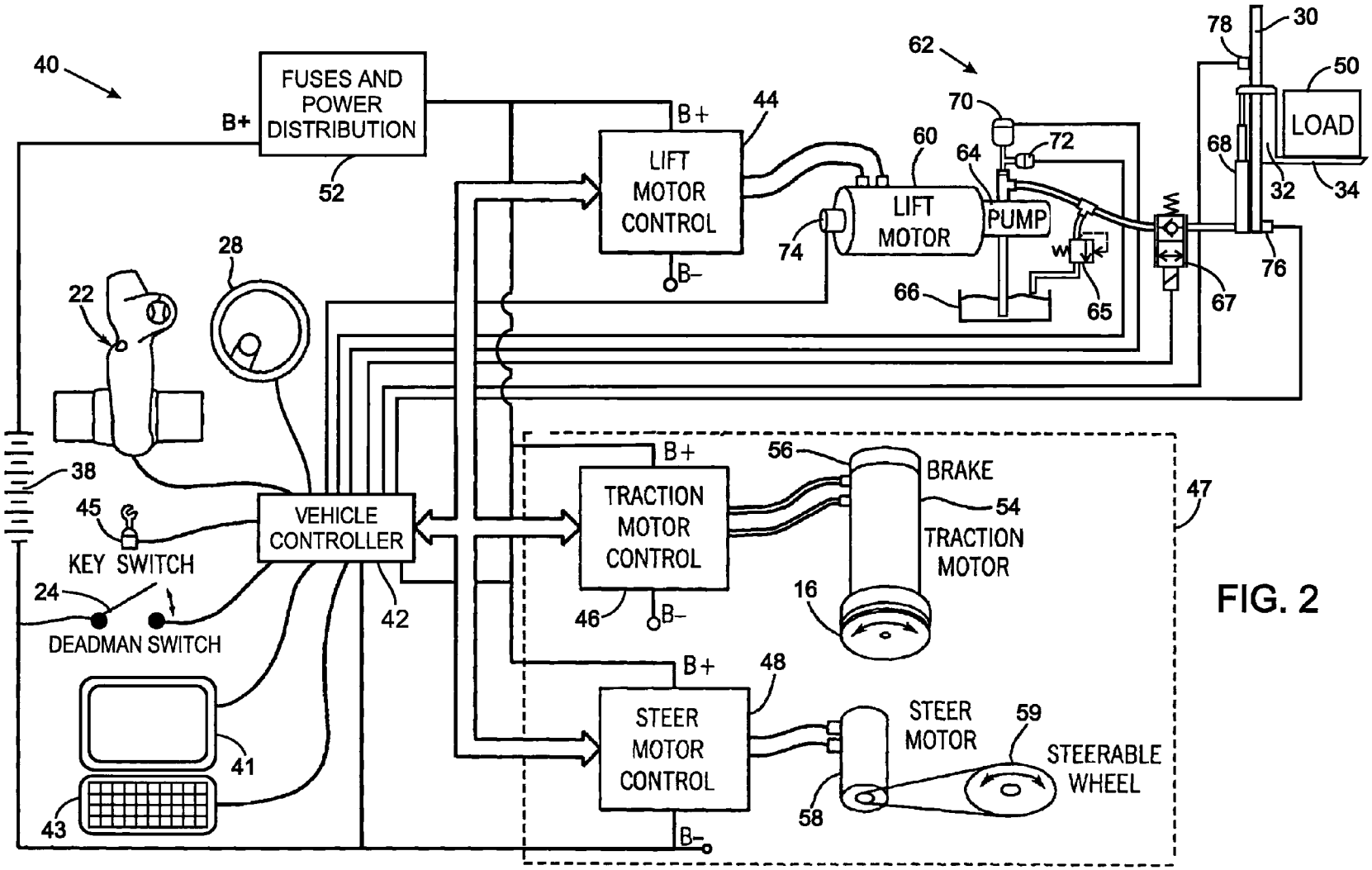
FIG. 2 is a schematic diagram of the control system for the material handling vehicle.

With reference to FIG. 2, the multi-function control handle 22 and steering wheel 28 are part of a control system 40 for the material handling vehicle 10. The control system 40 includes a vehicle controller 42 that is a microcomputer based device that executes software which controls operation of other components on the vehicle. A conventional information display 41 and a keyboard 43 enable the operator to interface with the vehicle controller 42. The vehicle controller 42 also receives operator input signals from the multi-function control handle 22, the steering wheel 28, a key switch 45, and the deadman switch 24. In response to those received signals, the vehicle controller provides command signals to a lift motor control 44 and a drive system 47 that includes both a traction motor control 46 and a steer motor control 48. The drive system 47 provides a motive force for driving and steering the material handling vehicle 10 in a selected direction, while the lift motor control 44 governs motion of the carriage 32 along a mast 30 to raise or lower the load 50, as described below. The material handling vehicle 10 and its control system 40 are powered by one or more batteries 38, coupled to the vehicle controller 42, drive system 47, and lift motor control 44 through a bank of fuses or circuit breakers 52. Although a battery powered material handling vehicle is being used in the disclosure herein, the present invention also can be used on a vehicle that is powered by an internal combustion engine or a fuel cell.

The traction motor control 46 activates an electric traction motor 54 which is connected to the wheel 16 to provide motive force to the material handling vehicle 10. The speed and direction of the traction motor 54 are selected by operation of the multi-function control handle 22. The wheel 16 is also connected to friction brake 56 through the traction motor 54, providing both a service and parking brake function for the material handling vehicle 10. The steer motor control 48 is connected to operate a steer motor 58 and associated steerable wheel 59, in response to the operator rotating the steering wheel 28. The direction of rotation of the steerable wheel 59 and the travel control command from multi-function control handle 22 determine the direction of motion of the material handling vehicle.

Of particular significance to the present invention is that the lift motor control 44 controls application of electric current to a hydraulic lift motor 60 which is connected to a hydraulic circuit 62. The hydraulic circuit 62 propels the carriage 32 and forks 34 along the mast 30, thereby moving the load 50 up or down, depending on the direction selected at the multi-function control handle 22. The lift motor 60 drives a fixed positive displacement pump 64 that produces flow of fluid from a reservoir 66 to a hydraulic cylinder and ram assembly 68 connected between the body 14 of the material handling vehicle and the carriage 32. A solenoid operated, bidirectional control valve 67 couples the outlet of the hydraulic pump 64 to the hydraulic cylinder and ram assembly 68. A pressure relief valve 65 provides a release path to the reservoir 66 in the event that excessive pressure exists in the pump outlet line.

The hydraulic circuit 62 includes a pressure sensor 70 and a temperature sensor 72 that respectively sense the pressure and temperature of the fluid flowing between the hydraulic pump 64 and the hydraulic cylinder and ram assembly 68. The pressure sensor 70 and a temperature sensor 72 produce electrical signals that are applied to inputs of the vehicle controller 42. A speed sensor 74 is connected to the lift motor 60 and provides a measurement of the speed of the pump to the vehicle controller 42. Because the pump 64 is connected directly to the lift motor 60, the rotational speed of both devices is the same. That may not be true for other transmissions that couple the motor to the pump, in which situations the speed sensor 74 is attached directly to the hydraulic pump 64.

Lower and upper mast switches 76 and 78 are located along the path of travel of the carriage 32 on the mast 30 and are closed when the carriage is at the respective position of the switch. The lower mast switch 76 is closed when the carriage 32 is at the lower extremity of travel along the mast. The distance between lower and upper mast switches 76 and 78 is known and fixed. As will be described, the mast switches 76 and 78 provide a means by which the actual speed of travel of the carriage 32 can be measured by the vehicle controller 42.

As noted previously, the vehicle controller 42 responds to input signals via devices 22 and 28 from the operator indicating functions to be performed by the material handling vehicle 10. One of those functions is to raise and lower the load 50 by moving the carriage 32 along the mast 30 as commanded by the operator manipulating the multi-function control handle 22. The vehicle controller responds to that operator command by appropriately operating the lift motor control 44 and the solenoid operated, bidirectional control valve 67. To raise the carriage 32, the control valve 67 is opened and the lift motor control 44 is commanded to apply electric current to the lift motor 60 which drives the pump 64 to send fluid from the reservoir 66 through the control valve 67 to the cylinder and ram assembly 68. To lower the carriage 32, the control valve 67 is opened which allows fluid to be forced from the cylinder and ram assembly 68 by gravity acting on the carriage and any load that is present. The fluid flows backward through the pump to the reservoir 66. Alternatively a three-position, three-way control valve may be used to provide a separate direct path from the cylinder and ram assembly 68 to the reservoir 66.

Figure 3:
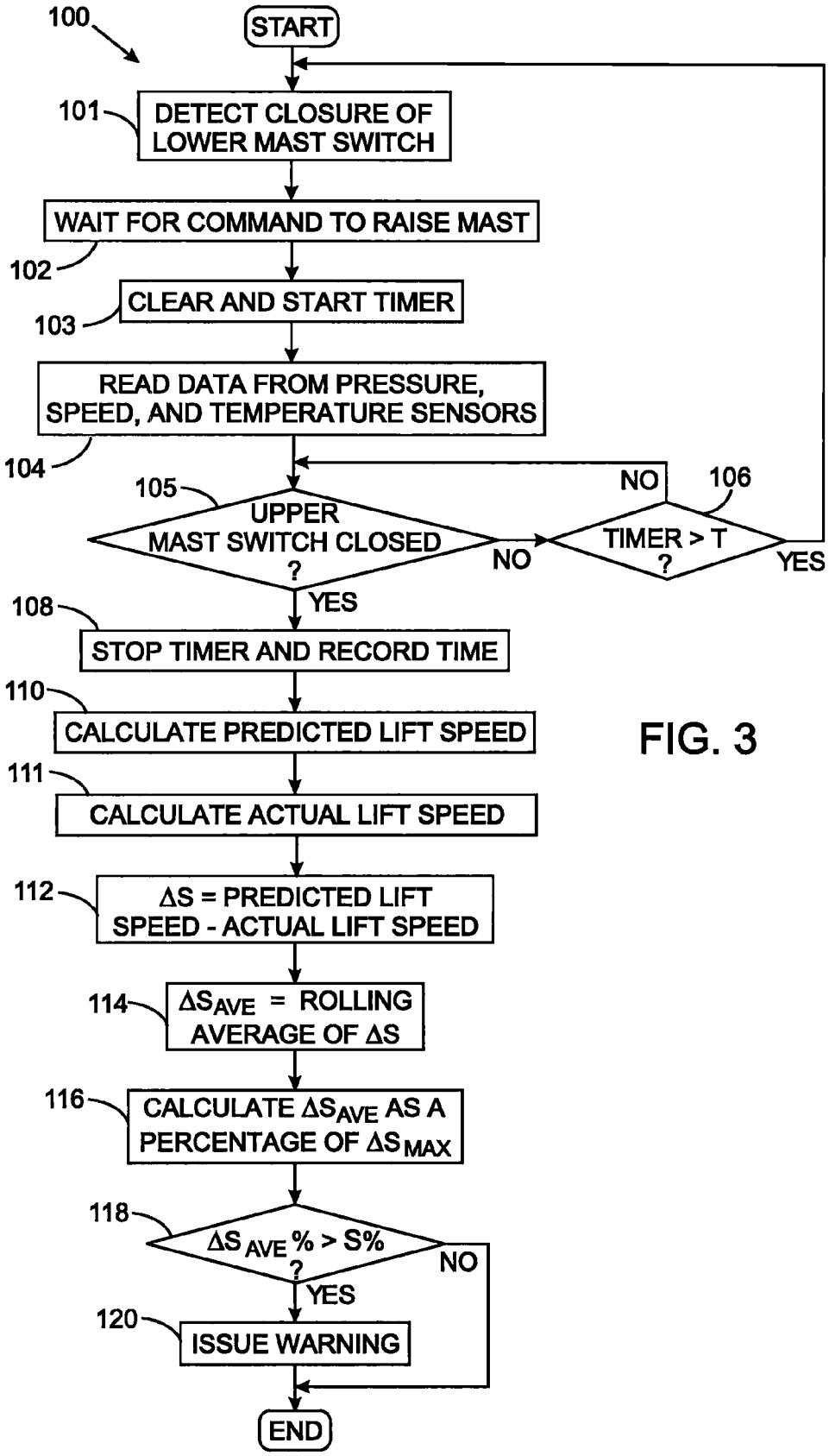
FIG. 3 is a flowchart of a method for monitoring performance of the hydraulic pump in the control system.

In addition to controlling the pump 64, the vehicle controller 42 executes a pump monitoring routine that examines the performance of the hydraulic system to determine whether the pump has experienced an excessive amount of wear and thereby requires maintenance or replacement. With reference to FIG. 3, the pump monitoring routine 100 is executed periodically based on a real time clock of the vehicle controller. The execution commences at step 101 at which the vehicle controller 42 waits until closure of the lower mast switch 76 occurs, which indicates that the carriage 32 is located at the bottom of the mast 30. Then at step 102, the vehicle controller 42 waits for a command from the operator to raise the carriage 32. Upon that occurrence, the vehicle controller 42 clears and starts a software implemented timer at step 103 to measure the travel time of the carriage on the mast 30. Next at step 104, the vehicle controller 42 reads and records the measurements from the pressure sensor 70, the fluid temperature sensor 72, and the lift motor speed sensor 74.

At step 105, the vehicle controller 42 reads the input signal from the upper mast switch 78 to determine whether that switch is closed, as occurs when the carriage 32 reaches the position of that switch. It should be understood that the upper mast switch 78 is located at a position along the mast to which the carriage 32 is frequently raised. If the switch is not found closed, the program execution branches to step 106 to determine whether the value of the timer is greater than an predefined amount of time T. That amount of time T is longer than the maximum time that it should ever take the carriage 32 to be raised to the position of the upper mast switch 78 under the heaviest allowable load and worst case normal operating conditions expected for the hydraulic system. This test at step 106 resets the pump monitoring routine 100 when the carriage 32 is not being raised sufficiently high to reach the upper mast switch 78. In that event, the process returns to step 101 to wait for the lower mast switch 76 to close, which occurs when the carriage 32 has been lowered to the bottom of the mast 30. From that point, the process will resume again when another operator command to raise the carriage is received.

If, however, the timer has not reached the value of T at step 106, the program execution returns to step 105 to examine the status of the upper mast switch 78. Thus, while the mast is raising, the pump monitoring routine 100 continues to loop through steps 105 and 106 until the closure of the upper mast switch 78 is detected or until the timer times out, i.e., reaches the value of T.

Assuming that the carriage 32 continues raising upward and eventually reaches the upper mast switch 78, the closure of that switch causes the pump monitoring routine to branch from step 105 to step 108 where the timer is stopped and its elapsed time recorded.

Although the remaining steps of the pump monitoring routine 100 can be performed by the vehicle controller 42, alternatively the recorded time can be uploaded into a computer in the facility where the material handling vehicle 10 is operating. In that latter case, the computer performs those remaining steps.

The monitoring of pump wear is premised on the concept that the lift speed of the carriage 32 is a function of the pump output flow minus any leakage which is expressed as Lift Speed=Pump Output−Leakage. For some pumps, the leakage can be modeled as flow through an orifice. In that case, a Predicted Lift Speed value is calculated at step 110 according to the equation:

$$\text{PREDICTED LIFT SPEED} = K * RPM - M * \sqrt{\frac{\text{PRESSURE}}{\text{TEMPERATURE}}} \quad (1)$$

where K is the pump displacement, RPM is the measured speed of the pump 64 from sensor 74, M is a constant, PRESSURE is the pressure at the outlet of the pump 64 as measured by sensor 70, and TEMPERATURE is the temperature of the fluid at the pump outlet as measured by sensor 72. The values for K and M are derived for a specific type of pump on a particular model of material handling vehicle and stored in the memory of the vehicle controller 42 of each material handling vehicle 10 of that model. Alternatively, values for K and M can be derived for each particular material handling vehicle 10 at time of manufacture.

For other pump designs the leakage flow can be modeled flow down a narrow tube instead of through orifice. In this case, the Predicted Lift Speed value is calculated at step 110 according to the alternative equation:

$$\text{PREDICTED LIFT SPEED} = K*\text{RPM} - M*\text{TEMPERATURE}*\sqrt{\text{PRESSURE}} \quad (2).$$

The appropriate equation and values for terms K and M are derived for a specific type of pump on a particular model of material handling vehicle and stored in the memory of the vehicle controller 42 of each material handling vehicle 10 of that model. Alternatively, values for K and M can be derived for each particular material handling vehicle 10 at time of manufacture. Those values are derived as follows.

K is the pump displacement that results from one cycle of the pump, e.g., produced by one rotation of the pump shaft. The pump displacement depends on the volume change of the hydraulic actuator, such as the cylinder and ram assembly 68. So for a particular cylinder diameter and piston displacement of the cylinder and ram assembly 68, each meter of motion is equivalent to a volume of fluid that flows into the cylinder. If to lift the carriage 32 one meter per minute (Lift Speed) requires X amount of fluid per minute and one pump rotation produces Y amount of fluid, then the pump speed (RPM) needed to provide that fluid flow rate is given by X/Y. The values of X and Y can be determined empirically for a given model of material handling vehicle while lifting its carriage one meter per minute. Therefore, for a new pump with zero leakage, the expression Lift Speed=K*RPM is rewritten as K=(Lift Speed)/RPM=(Lift Speed)/(X/Y) and the latter equation is solved using the measured values.

To derive a value for the constant M, the leakage flow for a new pump is modeled by flow through a small orifice in a larger pipe which is given by the expression:

$$Q = C_d A \sqrt{\frac{1}{1-\beta^4}} \sqrt{\frac{2(P1-P2)}{\rho}} \quad (3)$$

where Q is the amount of flow through the orifice, $C_d$ is a coefficient of discharge, A is the area of the orifice, β is the ratio of the diameter of the orifice to the diameter of the pipe in which the orifice is located, (P1-P2) is a pressure drop across the orifice, and ρ is the density of the hydraulic fluid.

Applying this model to pump leakage, the change in fluid density is relatively small for the range of pressures and temperatures experienced by a typical material handling vehicle. As a result, the effects of pressure and temperature may sometimes be ignored, thereby making fluid density a constant within a nominal range of temperatures. In addition, the ratio β of the leakage orifice diameter to the overall diameter of the pump outlet is relatively small and its effect becomes an even smaller factor when raised to the fourth power. Therefore, the square root term containing β can be considered as a constant value of one. As a consequence, the pump leakage is a strong function of the area (A) of the leakage path and that area is a squared term, e.g., if the pump wear increases a leakage gap by a factor of two, the influence on leakage flow increases by a factor of four. As with most turbulent flows, the leakage flow is a function of the square root of the pressure drop (P1-P2) across the leakage orifice. That pressure drop in a typical pump is the difference between the inlet and outlet pressure and the inlet pressure in many systems can be considered equal to atmospheric pressure. Therefore, the leakage pressure drop (P1-P2) in Equation (3) can be considered as only the outlet pressure (PRESSURE) of the pump 64. This enables the leakage equation to be simplified to:

$$Q = M\sqrt{\text{PRESSURE}} \quad (4)$$

where M incorporates the values of A, $C_d$, β, and $\sqrt{2/\rho}$.

As noted M is derived for a new pump. Over time as the leakage area A increases, the actual value of M changes. By keeping the value of M constant when calculating the Predicted Lift Speed in Equation (1) or (2), an indication of pump wear is provided by comparing the Predicted Lift Speed to the actual measured lift speed.

Referring again to the flowchart of FIG. 3, after the Predicted Lift Speed has been calculated, the pump monitoring routine 100 advances to step 111 at which the Actual Lift Speed is derived. That derivation is based on the timer value recorded at step 108 and the fixed distance between the upper and lower mast switches 76 and 78 (Actual Lift Speed=Distance/Timer Value). It should be appreciated that other mechanisms, such as a velocity sensor, can be used to provide the Actual Lift Speed of the carriage 32.

At step 112, the difference ΔS between the Predicted Lift Speed and the Actual Lift Speed is calculated. Then, the newly calculated lift speed difference ΔS is applied to a rolling average of a plurality of lift speed differences to derive the average lift speed difference $\Delta S_{AVE}$ at step 114. For a new pump, the average lift speed difference is near zero, i.e., within a relatively small standard deviation. Over time, wear of the hydraulic pump 64 results in an increase in the difference between the Predicted Lift Speed and the Actual Lift Speed. As a result, the average lift speed difference increase provides an indication of the amount of pump wear. Furthermore, average lift speed difference $\Delta S_{AVE}$ reaching a predefined threshold value $\Delta S_{MAX}$ denotes that excessive wear has occurred. That threshold value $\Delta S_{MAX}$ can be determined empirically by intentionally operating the vehicle hydraulic circuit 62 until the actual lift speed fails to meet the minimum requirements set by the model specifications. During that operation the parameters of the pump monitoring system are recorded to provide a series of values for the average lift speed difference.

This enables, the pump wear to be indicated as a percentage based on the amount that the presently derived value for the average speed difference $\Delta S_{AVE}$ is of the threshold value $\Delta S_{MAX}$. That wear percentage is calculated at step 116 of the pump monitoring routine 100. Next at step 118, the new wear percentage is compared to determine whether it exceeds a given percentage amount S % at which it is desirable to provide a warning to the operator of the material handling vehicle or to maintenance personnel at the facility where the vehicle is operating. The warning indicates that significant pump wear has occurred and that the personnel should consider performing maintenance or replacement of the pump before a catastrophic failure occurs. Such a warning, if necessary, is issued at step 120 before the pump monitoring routine ends. For example the warning can be a message presented on the information display 41 of the material handling vehicle 10, however other visual or audible annunciators can be used.

The rate of change of the difference AS between the Predicted Lift Speed and the Actual Lift Speed or the rate of change of the average lift speed difference $\Delta S_{AVE}$ also can be used as an indication of excessive pump wear. Typically those rates of change increase as the amount of wear becomes more severe. A high rate of change indicates that preventative maintenance (new filter, flush & replace hydraulic oil, etc.) should be done to reduce over all costs.

Alternatively, the use of temperature in the previously described pump monitoring method may be eliminated and still provide an indication of the amount of pump wear. In this alternative, the temperature sensor 72 can be eliminated from the hydraulic system and the pump monitoring routine simplified by not having to read and utilize the temperature in calculating the predicted lift speed in Equation (1). In this alternative embodiment, the equation used to calculate the Predicted Lift Speed becomes:

$$\text{PREDICTED LIFT SPEED}=K*\text{RPM}-M*\sqrt{\text{PRESSURE}} \quad (5)$$

The remaining steps of the process, such as in the pump monitoring routine 100, are the same as described previously.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A method for estimating wear of a pump connected to a hydraulic actuator that moves a member on a material handling vehicle, said method comprising:

operating the pump to drive the hydraulic actuator to move the member on the material handling vehicle;

determining an actual speed of the member;

sensing an operating parameter of the pump and a characteristic of fluid flow produced by the pump in response to the sensing, calculating a predicted speed of the member;

comparing the predicted speed to the actual speed; and in response to the comparing, providing an indication of a degree of wear of the pump.

2. The method as recited in claim 1 wherein calculating a predicted speed comprises calculating a predicted pump output, calculating a predicted pump leakage, and subtracting the predicted pump leakage from the predicted pump output.

3. The method as recited in claim 1 wherein the sensing comprises sensing speed of the pump, and sensing pressure of fluid conveyed from the pump to the hydraulic actuator; and wherein calculating the predicted speed is based on the speed of the pump and the pressure of fluid.

4. The method as recited in claim 3 wherein the sensing further comprises sensing temperature of the fluid; and wherein calculating the predicted speed also is based on the temperature of the fluid.

5. The method as recited in claim 1 wherein comparing the predicted speed to the actual speed comprises calculating a difference between the predicted speed and the actual speed, and calculating an average difference between the predicted speed and the actual speed; and wherein providing an indication of a degree of wear is in response to the average difference.

6. A method for estimating wear of a pump connected to a hydraulic actuator that moves a member on a material handling vehicle, said method comprising:

operating the pump to drive the hydraulic actuator to move the member on the material handling vehicle;

determining an actual speed of the member;

sensing speed of the pump;

sensing pressure of fluid conveyed from the pump to the hydraulic actuator;

calculating a predicted speed based on the speed of the pump and the pressure of the fluid;

comparing the predicted speed to the actual speed; and in response to the comparing, providing an indication of a degree of wear of the pump.

7. The method as recited in claim 6 wherein calculating a predicted speed comprises calculating a predicted pump output based on the speed of the pump, calculating a predicted pump leakage based on the pressure, and subtracting the predicted pump leakage from the predicted pump output.

8. The method as recited in claim 6 further comprising sensing temperature of the fluid and wherein calculating a predicted speed is further based on the temperature.

9. The method as recited in claim 8 wherein the predicted speed is calculated according to the following expression:

$$\text{PREDICTED SPEED} = K*RPM - M*\sqrt{\frac{\text{PRESSURE}}{\text{TEMPERATURE}}}$$

where K is a displacement of the pump, RPM is the speed of the pump, M is a constant, PRESSURE is the pressure of the fluid, and TEMPERATURE is the temperature of the fluid.

10. The method as recited in claim 8 wherein the predicted speed is calculated according to the following expression:

$$\text{PREDICTED LIFT SPEED}=K*\text{RPM}-M*\text{TEMPERATURE}*\sqrt{\text{PRESSURE}}$$

where K is a displacement of the pump, RPM is the speed of the pump, M is a constant, TEMPERATURE is the temperature of the fluid, and PRESSURE is the pressure of the fluid.

11. The method as recited in claim 6 wherein the predicted speed is calculated according to the following expression:

$$\text{PREDICTED SPEED}=K*\text{RPM}-M*\sqrt{\text{PRESSURE}}$$

where K is a displacement of the pump, RPM is the speed of the pump, M is a constant, and PRESSURE is the pressure of the fluid.

12. The method as recited in claim 6 wherein comparing the predicted speed to the actual speed comprises calculating a difference between the predicted speed and the actual speed.

13. The method as recited in claim 12 further comprising calculating an average difference between the predicted speed and the actual speed; and wherein the providing an indication of a degree of wear is in response to the average difference.

14. The method as recited in claim 13 further comprising determining a threshold difference and the indication of a degree of wear is provided in response to the average difference exceeding the threshold difference.

15. The method as recited in claim 12 further comprising determining a threshold; and deriving a value based on the difference between the predicted speed and the actual speed, and the indication of a degree of wear is provided in response to the value exceeding the threshold.

16. The method as recited in claim 12 wherein the indication of a degree of wear is provided in response to a rate of change of the difference.

17. An apparatus for estimating wear of a pump connected to a hydraulic actuator that moves a member on a material handling vehicle, said apparatus comprising:

at least one sensing device that produces a signal from which an actual speed of the member is determined;

a first sensor for sensing speed of the pump;

a second sensor for sensing pressure of fluid conveyed from the pump to the hydraulic actuator; and a controller connected to the at least one sensing device, and the first and second sensors for calculating a predicted speed based on the speed of the pump and the pressure of the fluid, comparing the predicted speed to the actual speed, and, in response to the comparing, providing an indication of a degree of wear of the pump.

18. The apparatus as recited in claim 17 further comprising a third sensor for sensing temperature of the fluid; and wherein the controller calculates the predicted speed also based on the temperature.

19. The apparatus as recited in claim 17 wherein the at least one sensing device comprises a pair of sensors located at two different positions along a path of motion of the member and each of the pair of sensors being operated when the member is proximate to a respective one of those positions.

20. The apparatus as recited in claim 17 wherein the controller compares the predicted speed to the actual speed by calculating a difference between the predicted speed and the actual speed.

21. The apparatus as recited in claim 20 wherein the controller further calculates an average difference between the predicted speed and the actual speed; and provides an indication of a degree of wear in response to the average difference.

22. The apparatus as recited in claim 21 wherein the controller provides the indication of a degree of wear in response to the average difference exceeding a threshold value.

23. The apparatus as recited in claim 17 further comprising determining a threshold difference; and the indication of a degree of wear is provided in response to a rate of change of the threshold difference.

* * * * *